United States Patent [19]

Gazzera

[11] Patent Number: 4,784,579

[45] Date of Patent: Nov. 15, 1988

[54] HYDRAULIC-PNEUMATIC POWER TRANSFER UNIT

[75] Inventor: Raymond W. Gazzera, Scottsdale, Ariz.

[73] Assignee: Allied-Signal Inc., Morris Township, Morris County, N.J.

[21] Appl. No.: 944,496

[22] Filed: Dec. 19, 1986

[51] Int. Cl.[4] ..... F04B 1/18; F04B 35/02

[52] U.S. Cl. ..... 417/246; 417/266; 417/388

[58] Field of Search ..... 417/383, 385, 386, 387, 417/388, 265, 266, 246, 267, 390, 393, 339, 347, 381; 98/1.5; 60/39.142, 39.15

[56] References Cited

U.S. PATENT DOCUMENTS

| | | | |
|---|---|---|---|
| 1,288,966 | 12/1918 | Nielsen | 417/265 |
| 2,452,704 | 11/1948 | Wahlmark | 98/1.5 |
| 3,249,053 | 5/1966 | Govan | 417/390 |
| 4,443,160 | 4/1984 | Bertholo | 417/388 |
| 4,478,556 | 10/1984 | Gozzi | 417/266 |

FOREIGN PATENT DOCUMENTS

| | | | |
|---|---|---|---|
| 75618 | 9/1981 | European Pat. Off. | 417/339 |

*Primary Examiner*—Leonard E. Smith

*Attorney, Agent, or Firm*—R. Steven Linne; James W. McFarland

[57] ABSTRACT

Disclosed herein is a hydraulic to pneumatic power transfer unit which converts a high pressure oil flow into a flow of high pressure air by means of three stages of piston pumps and characterized by a first stage having a pair of linked pistons of substantially equal size both supplying air to a second stage piston which is directly linked to a third stage piston so that the pair of second and third stage pistons work alternately with the pair of first stage pistons and the linkage between each pair of pistons actuate spool valves which control the motion of the other pair of pistons.

A further improvement is also disclosed in which an internal oil reservoir and a swash-plate pump is added to the system so that it may be powered by a rotating shaft instead of a flow of oil. In addition, the pulses of oil produced by the swash-plate pump directly control the piston pairs without the need for spool valves.

7 Claims, 3 Drawing Sheets

HYDRAULIC-PNEUMATIC POWER TRANSFER UNIT

BACKGROUND OF THE INVENTION

This invention relates generally to pumps and more specifically to piston type fluid intensifiers in which one fluid, in this case hydraulic oil, is used to increase the pressure of a second fluid, in this case air.

Fluid intensifiers may be of various configurations and used in many types of industrial devices. For example, the second, pumped fluids may be the same as, or even a portion of, the first, powering fluid as in the well-known "water rams" used in less developed areas to supply water under pressure from a stream.

Or the second fluid may be similar to the first but without intermixing as in oil driven fuel transfer pumps.

The fluids may even be of different types, i.e. one gas and the other liquid, as in air driven oil pumps or hydraulically driven air compressors.

It is this latter configuration which is of most interest in the present invention.

Compressed air is becoming more useful in many industrial applications, but one of the most demanding applications is in modern aircraft in which air is used for environmental support systems and for pneumatic control systems. Air is usually supplied to such systems, and for other uses, by bleeding a small amount of air from the compressor stages of the gas turbine propulsion engines or auxiliary power units. However, many modern gas turbines are designed so that very little excess air is available for such use even though sufficient power is available to drive a separate pump.

Prior art air pressure intensifiers have several problems which limit their life and/or reliability. Such intensifiers, or air compressors, are generally multi-stage, positive displacement types in which several pistons of graduated sizes (i.e. stages) are mechanically driven by a crankshaft or Scotch yoke mechanism. The first stage piston, and its check valves, tend to be quite large, resulting in high inertia forces when running at high speeds. These high inertia forces end to cause early failures, particularly in the check valves.

On the other hand, the last stage pistons are small but highly loaded from the pressure of the compressed air. This high face load, when combined with side forces from the crank or Scotch yoke, causes excessive bearing stresses on the side of the pistons resulting in rapid wear of the sealing parts. Typically, commercially available units have a mean time between failure of only about 500 to 1500 hours.

Furthermore, the geometry of a crankshaft driven unit results in a lot of wasted space which is only partly eliminated in the Scotch yoke design.

Thus, it should be apparent that there is need in the art for an improved air pressure intensifier.

A cursory search of the available prior art shows the following U.S. patents related to the general subject matter of the present invention: U.S. Pat. Nos. 2,293,097; 2,296,647; 2,508,298; 2,864,313; 3,059,433; 3,200,596; 3,809,502; 4,212,597; and 4,523,895.

In particular, the disclosures of U.S. Pat. Nos. 3,407,601 and 3,916,931 illustrate and describe some of the complexities and problems of such equipment.

SUMMARY OF THE INVENTION

A major objective of the invention is to provide a new and improved pneumatic intensifier of relatively simple design and low cast having a minimum of moving parts and seals so as to reduce or eliminate maintenance and/or adjustments.

Another object of the present invention is to provide a hyraulically operated piston type pneumatic intensifier in a compact unit which wastes less space and has less side loads on the pistons than crankshaft operated units.

A further object of the present invention is to provide a fluid intensifier which may be operated at high speeds and high pressures without undue inertia loads on the components.

In accordance with these objectives, the present invention comprises, in its most general sense, a block-like housing containing two reciprocating piston assemblies, two reciprocating spool valves, and numerous interconnected fluid passageways all cooperating to convert a flow of high pressure oil to a flow of high pressure air.

A further improvement to this basic invention is also disclosed wherein an internal oil reservoir and a swash-plate pump is added to the system to produce discrete pulses of high pressure oil via a mechanical connection to a rotating shaft. The pulses of oil directly operate the reciprocating piston assemblies in sequence without a need for the spool valves of the basic invention. Thus, high pressure air may be produced from either a hydraulic or mechanical source.

The fluid intensifier, or hydraulically driven air compressor, features three stages of graduated sized air cylinders, each of which contains an air compressing piston moved linearly by hydraulic pressure. This arrangement takes up less space than a crank-shaft drive and eliminates side loads on the air pistons. Instead of a single large first stage air piston, however, two smaller pistons are in sequence thereby resulting in a total of four pistons in this three stage air intensifier. The use of smaller pistons and their associated valves in the first stage reduces inertia loads at high speeds.

The four pistons are arranged in pairs and each pair is connected by a lightly loaded link which functions to retract one of the pair on a suction stroke while the other of the pair is on its compressing stroke. The link also functions to trip a sequencing spool valve, using a high backlash mechanism, to establish the timing between the pair of pistons. That is, the spool valve change positions only when the link and piston are near the end of their stroke. When the pistons are in any intermediate position, friction prevents valve motion.

The valve logic is established by connecting passageways in the intensifier housing and operate to cause the piston pairs to stroke alternately as will be described in more detail below.

Thus, each complete cycle of the intensifier causes air to be compressed in three stages by a series of four hydraulically operated pistons which automatically reciprocate in a predetermined sequence. For example, movement of the first stage pair of pistons near the end of their stroke causes the nearby spool valve to change position so that hydraulic oil is ported to the second and third stage pair of pistons to begin their stroke. Near the end of their stroke, that pair of pistons causes its nearby spool valve to change position and port oil back to the first stage pair of pistons. This sequence is continuously repeated during operation of the compressor so that a flow of high pressure hydraulic oil is mechanically converted into a flow of high pressure air.

With this arrangement, the flow of oil can be interrupted at any point in the cycle but resumed later at the same point when oil pressure is restored.

Another advantage of this invention is that the level of pressure of the output air stream may be designed to be either higher or lower than the pressure of the input oil stream depending on the size selected for each piston assembly.

The concepts set forth above have been described with reference to an oil powered air intensifier. However, the same concepts are equally applicable to air powered oil intensifiers.

In the improved version, a special type of oil pump is included in the system to provide the motive force for the pistons. A swash-plate having at least four pumping cylinders is driven by a rotating shaft to produce discrete pulses of high pressure oil from each cylinder. By selectively connecting each pumping cylinder to one of the air compressor pistons, the harmonic motion of the pump is transferred to the pistons without the need for sequencing spool valves.

However, to insure that an adequate supply of oil is available at all times, an internal reservoir (preferably pressurized) and associated pressure relief valves are provided in the system as discussed in more detail below.

Thus, it should be apparent that the present invention provides an improved pneumatic intensifier in various configurations suitable to meet the requirements of a particular installation.

BRIEF DESCRIPTION OF THE DRAWINGS

While this specification concludes with claims particularly pointing out and distinctly claiming the subject matter which is regarded as the invention, it is believed that the invention, objects, features and advantages thereof may be better understood from the following detailed description of a presently preferred embodiment when taken in connection with the accompanying drawings in which:

DESCRIPTION OF THE PREFERRED EMBODIMENT

Figure 1:
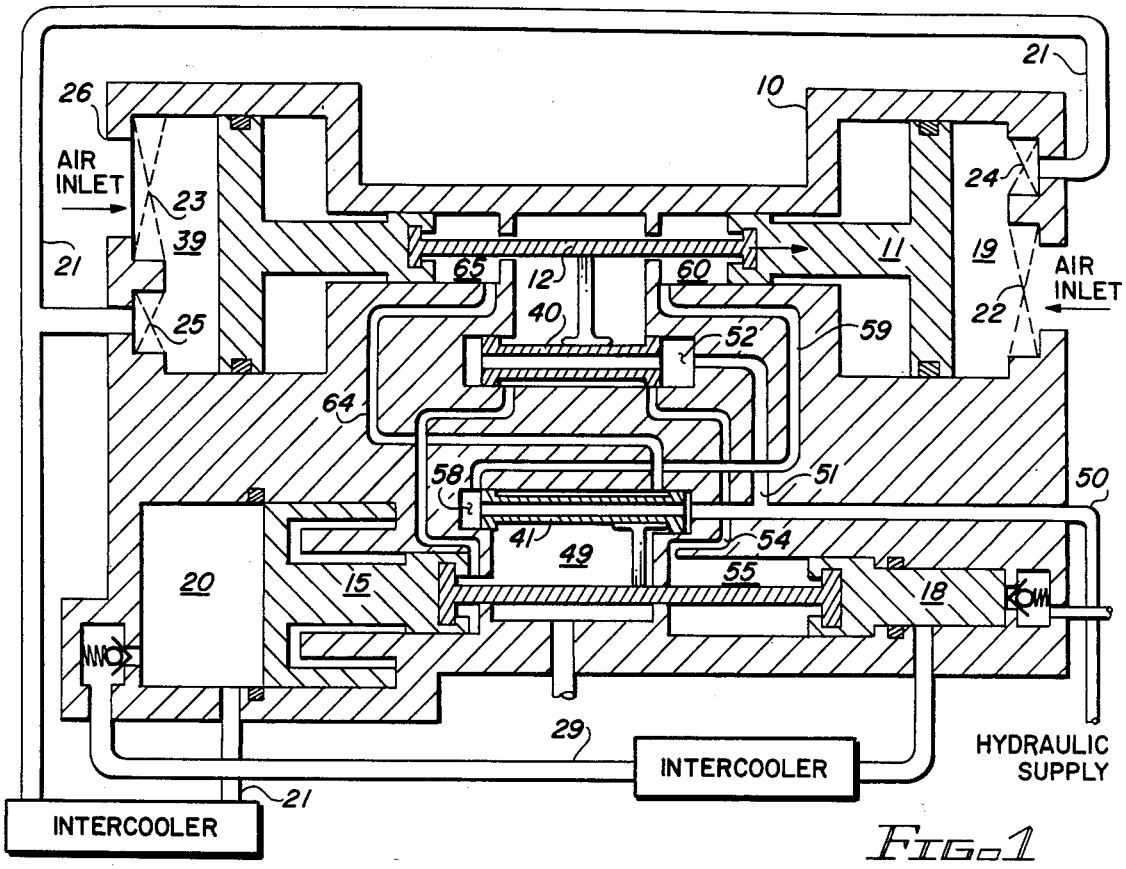
FIG. 1 is a cross-sectional illustration of a fluid intensifier in accordance with the present invention where the first stage reciprocating pistons are in the middle of a working cycle while the second and third stage piston assembly is at rest.

Referring to FIG. 1, the apparatus of the present invention includes a block-like housing (10) containing an upper pair of reciprocating pistons (11–14) and a lower pair of reciprocating pistons (15–18) which cooperate to move air from the two upper chambers (19, 39) to lower left chamber (20) through pipe (21). Check vale (22) prevents air in chamber (19) from flowing back out the air inlet while check valve (23) allows air to enter into the upper left chamber (39). This part of the cycle is the first stage of air compression.

Figure 2:
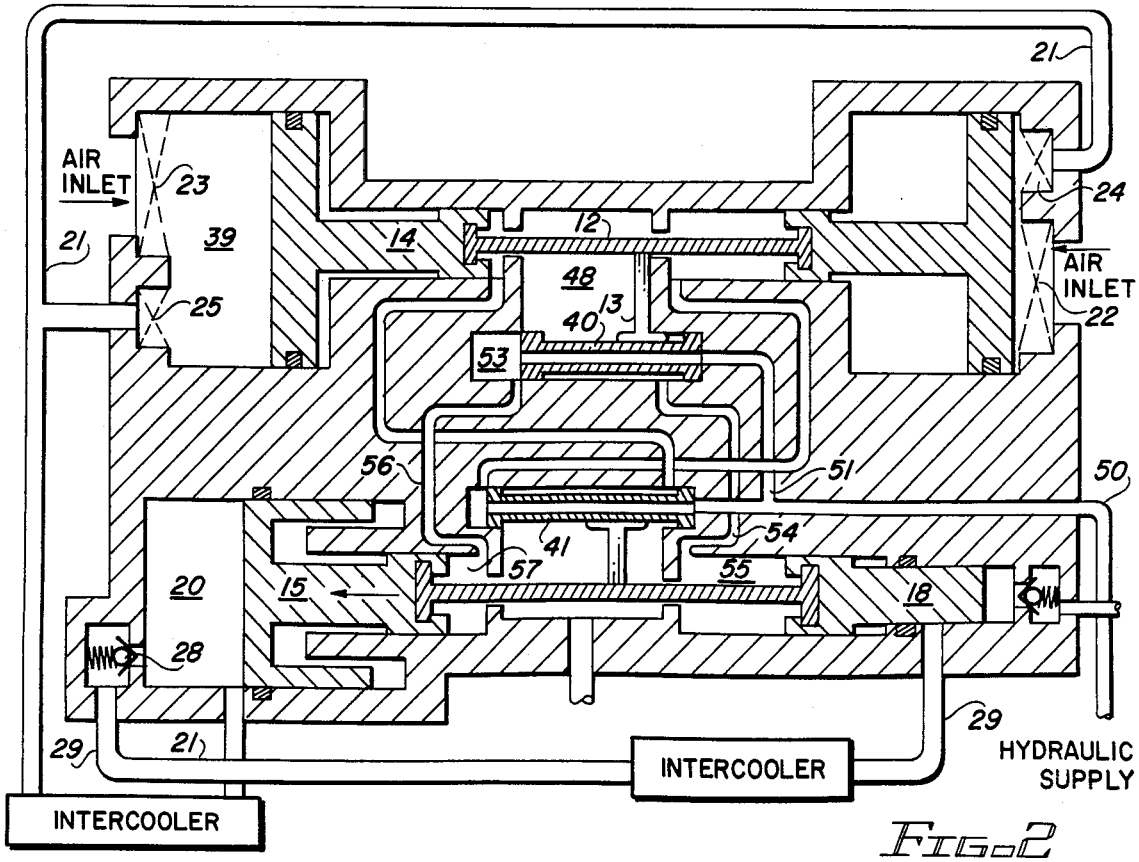
FIG. 2 is an illustration of the next step in the cycle where the second stage piston is working while the first stage pistons are at rest.

During the second stage of air compression, as shown in FIG. 2, air in chamber (20) is compressed further by piston (15) and forced through check valve (28) into pipe (29). Check valves (24, 25) in the entrances to pipe (21) prevent backflow of air into the upper chambers (19, 39).

Figure 3:
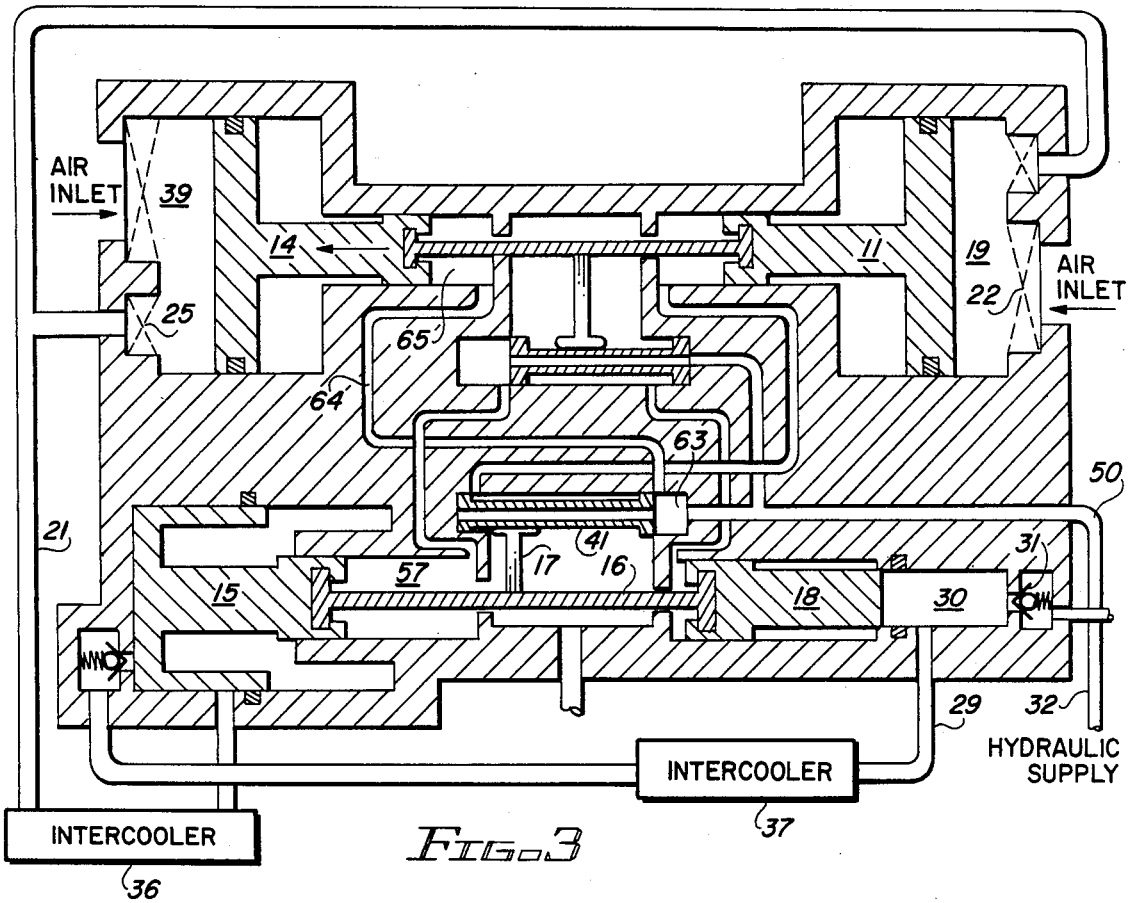
FIG. 3 is an illustration of a later step in the cycle where the first stage pistons are again working while the second and third stage assembly is at rest.

As shown in FIG. 3, air from pipe (29) enters the lower right chamber (30) where it is further compressed by piston (18) and forced through check valve (31) into the high pressure delivery pipe (32) thus completing the third stage of compression. Preferably, the air transfer pipes (21, 29) have intercooler means (36, 37) for dissipating some of the heat due to compression.

Figure 4:
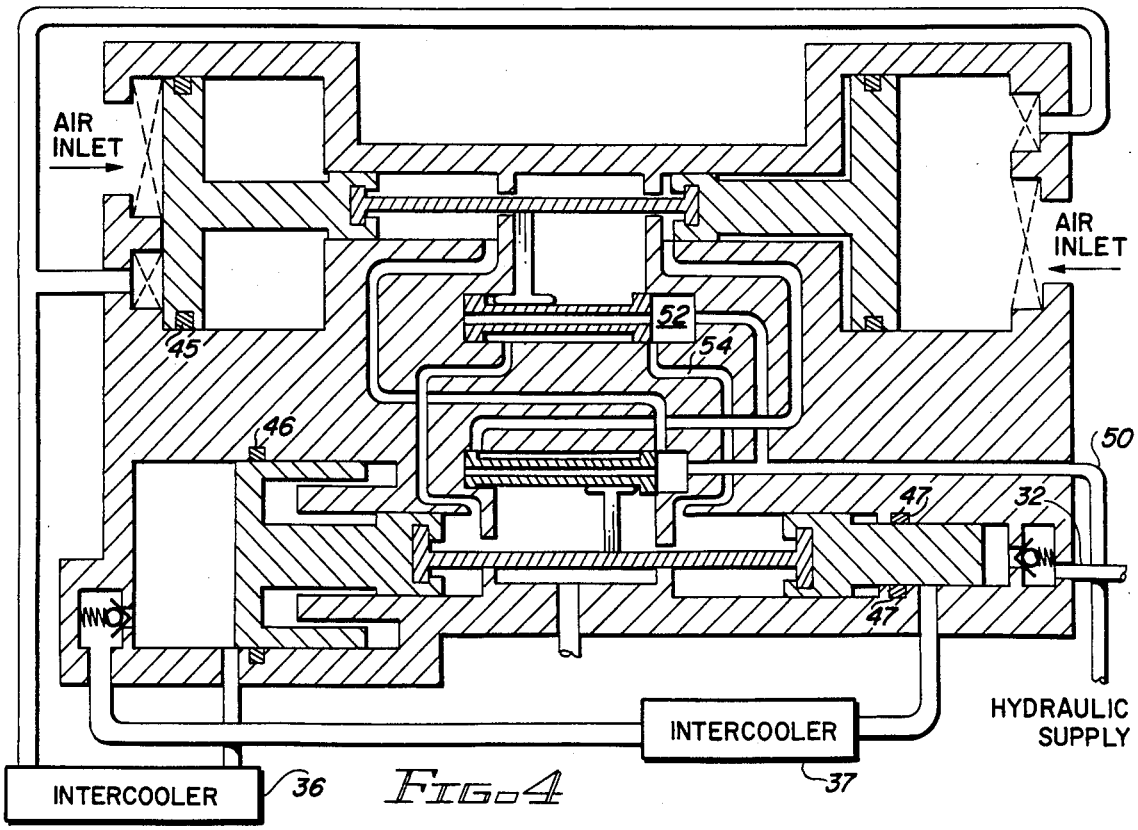
FIG. 4 is an illustration of the final step in the cycle where the third stage piston is working.

The air compressing pistons (11, 14, 15, 18) are moved by the force of high pressure hydraulic oil which, in this embodiment, is controlled by two sliding spool valves (40, 41) shown in FIG. 4. The upper spool valve (40) controls the action of the lower pair of air pistons (15, 18) and the lower spool valve controls the action of the upper pair of pistons (11, 14) as explained in more detail below. FIG. 4 also illustrates various means for sealing the reciprocating pistons such as metallic rings (45), elastomeric "O-rings" (46), or high pressure seals (47).

The operation of the apparatus is best explained by following the flow of hydraulic oil throughout one complete cycle starting with the first of the three stages of air compression.

Referring back to FIG. 1, high pressure hydraulic oil from any suitable source (not shown) flows through main supply passage (50) into the interior of housing (10). A branch passage (51) leads upward into a chamber (52) on the right side of upper spool valve (40). At this point in the cycle, chamber (52) is in communication with a passage (54) which leads down to the oil chamber (55) behind the third stage air piston (18). High pressure oil in this chamber (55) exerts a force on air piston (18) holding it in a dwell mode at the end of its stroke.

At the same time, high pressure oil flows from main supply line (50) through the hollow interior of the lower spool valve (41) to chamber (58) on its left. This chamber (58) is now in communication with a passage (59) leading upwards to the oil chamber (60) behind the upper right-hand air piston (11). High pressure oil thus flows upward into chamber (60) exerting pressure on air piston (11) and moving it to the right. As previously discussed briefly, air piston (11) forces air out of chamber (19) past check valve (24) into pipe (21). At the same time air is drawn through left air inlet (26) past check valve (23) into chamber (39) by piston (14) which is also forced to move toward the right since it is attached to piston (11) by link (12). Oil in chamber (65) behind piston (14) is allowed to flow through passage (64) to the oil return area (49).

FIG. 2 illustrates a later moment in the cycle after piston (11) has been forced all the way to the right and is in a dwell mode. During the last portion of its movement, a tang (13) on link (12) has contacted and moved the upper spool valve (40) to the right so that passage (54), which had previously been in communication with the high pressure oil supply, is now in communication with the oil return area (48). Now oil flows from the high pressure supply line (50) up through the branch (51) and through the hollow interior of the upper spool valve (40) into the chamber (53) on its left. The chamber

(53) is now in communication with a passage (56) which leads the oil down into the chamber (57) behind the second stage air piston (15) forcing it to move to the left thereby compressing the air in lower left air chamber (20).

After piston (15) has moved all the way left, to the end ot its stroke, FIG. 3 shows that a tang (17) on the link (16) connecting the lower pair of pistons (15) and (16) has contacted and moved the lower spool valve (41) to the left. At this point, high pressure oil from the main supply line (50) flows into a chamber (63) on the right side of the lower spool valve (41) where it can flow upwards through passage (64) to a chamber (65) behind the upper left hand air piston (14) thereby moving it, and attached piston (11), to the left. This movement compresses the air in chamber (39) and forces it through check valve (25) into air pipe (21) while, at the same time, drawing fresh air into chamber (19) through check valve (22).

The third stage of air compression and the next step of the cycle, shown in FIG. 4, occurs after the top pair of air pistons (11 and 14) has moved to the end of their stroke. During the last portion of their movement, a tang (13) on the link (12) connecting the pair of pistons has contacted and moved the upper spool valve (40) to the left. Now high pressure oil from the main supply pipe (50) flows up branch (51) to the chamber (52) on the right hand side of the upper spool valve (40). Since chamber (52) is now in communication with passage (54), the oil flows through passage (54) into the chambers (55) behind the third stage air piston (18) moving it to the right. This movement compresses the air in air chamber (30) and forces it out past check valve (310 in the high pressure air delivery pipe (32).

Again, during the last portion of movement of the lower piston pair (15 and 18), a tang (17) on their connecting link (16) contacts and moves the lower spool valve (41) to the right.

Thus, the apparatus returns to the configuration shown in FIG. 1 and the entire cycle repeats.

Figure 5:
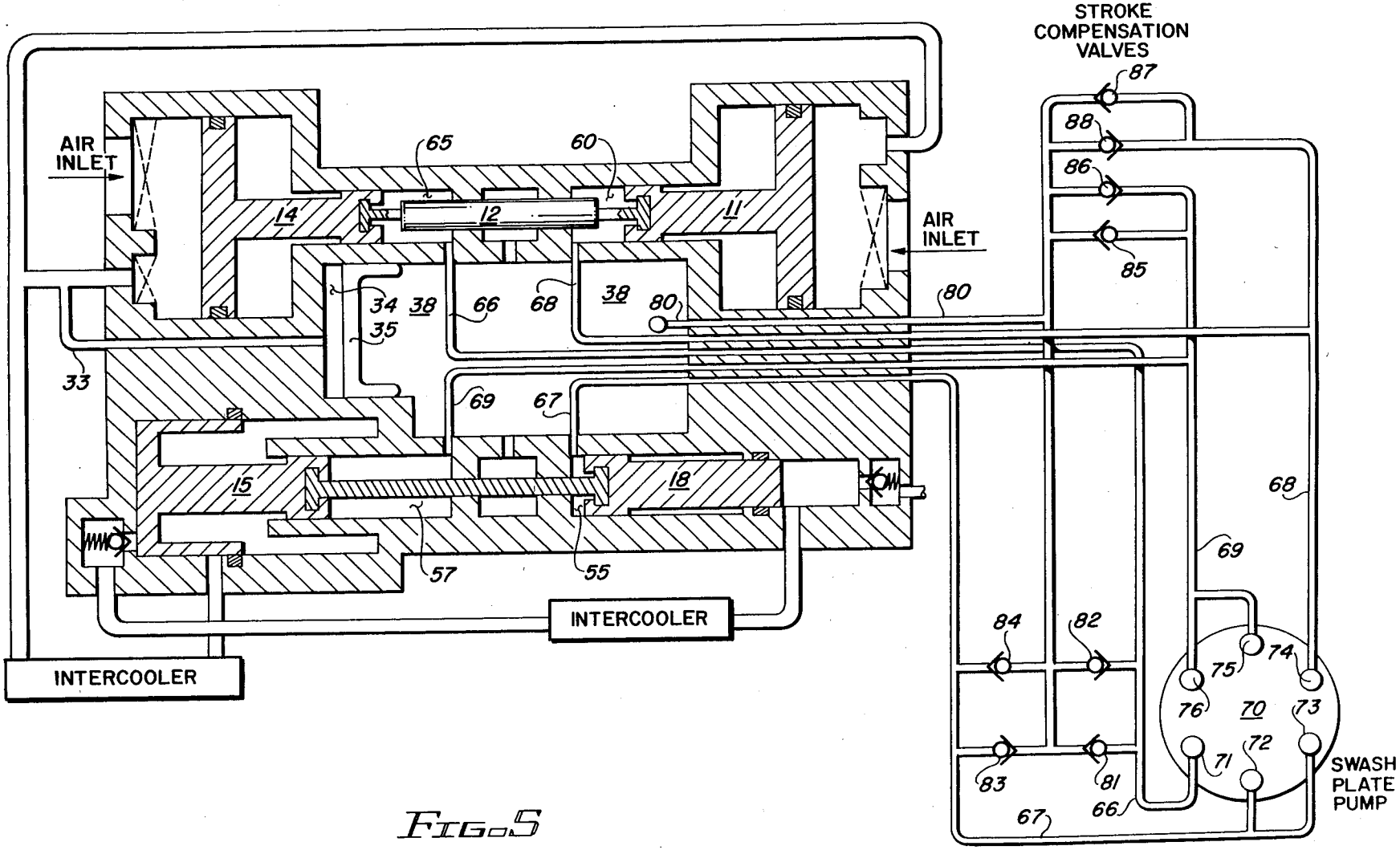
FIG. 5 is an illustration of the further improvement wherein an internal oil reservoir and a swash-plate pump have been added to the basic system.

Turning now to FIG. 5, which illustrates a further improvement to the basic invention, a special type of hydraulic pump (70) has been added to the system. The pump (70) is known in the art as a swash-plate pump which functions to convert mechanical energy from a rotating shaft into a flow of hydraulic fluid by means of several individual pumping cylinders operating in sequence. Such pumps are well-known in the art (see, for example, U.S. Pat. No. 4,620,475) and need no detailed description here. However, the piping arrangement of the present invention differs from that commonly used in the art. Typically, the oil output from each of the several pumping cylinders is combined into one delivery pipe so that the sequential pulse of oil from each cylinder is smoothed out to form a steady stream of fluid. In contrast, the present invention utilizes each individual pulse of oil to move one of the air compressing pistons of the basic invention. The sequential nature of these pulses eliminates the need for the two spool valves (40, 41) and also simplifies the fluid passageways as explained in more detail below.

Still referring to FIG. 5, pump (70) has six individual pumping cylinders (71–76) which are operated by an angled swash plate attached to a rotating shaft (not shown).

Each of the pump cylinders (71–76) is connected to a conduit (66–69) which leads to one of the air compressing pistons. For example, pump cylinder (71) is connected to conduit (66) which is in communication with chamber (65) behind air piston (14). Thus, as the swash plate is rotated, the hydraulic fluid in some of the pumping cylinders, for example (71), is being forced out of the cylinder, through its associated conduit, and into the chamber behind one of the air compressing pistons (14) moving it on a compression stroke. At the same time, hydraulic fluid in those pumping cylinders which are diametrically opposite, for example (74), is being sucked into the cylinder from its conduit and associated chamber (60) behind attached air piston (11) moving on an intake stroke.

As the swash plate continues to rotate, the hydraulic fluid in an adjacent pumping cylinder, for example (72), will be forced through its associated conduit (67) into a chamber (55) behind another one of the air compressing pistons (18) while the diametrically opposite pumping cylinder, for example (75), will receive fluid through conduit (69) from the chamber (57) behind attached air piston (15).

Thus, each of the air compressing pistons is moved in sequence by fluid from the pump cylinders.

In the event that the volume of fluid provided by a single pumping cylinder (e.g. 72) is not sufficient to move its associated air piston (18) far enough to complete its stroke, then an adjacent pumping cylinder (73) may be connected to the same conduit (67) so that its volume may be added to the chamber (55) without disrupting the sequence of operation.

Since it is not practical to exactly match the volume of each fluid chamber to one, or even two, of the pumping cylinders, the present invention contemplates the use of a reservoir (38) and stroke compensation (81–88) in the hydraulic circuit as follows.

Each of the conduits, for example (66), is connected to two pressure relief valves (81, 82) which are themselves connected through an oil make up line (80) to the reservoir (38).

One of the two valves is a high pressure relief valve (82) while the other is a low pressure relief valve (81). When the pumping cylinder (71) has supplied sufficient fluid to completely fill chamber (65) and thereby move piston (14) to the end of its stroke, any further rotation of the swash plate will cause the fluid pressure in conduit (66) to increase and open the high pressure relief valve (82) so that excess fluid escapes to the reservoir. Later in the cycle when all the fluid has been returned from chamber (65) to pumping cylinder (71) during its suction stroke, any additional fluid needed to fill cylinder (71) is supplied from the reservoir (38) through the low pressure relief valve (81).

It is preferred that the fluid pressure in the conduits not be permitted to become negative (i.e. below atmospheric) so the invention contemplates pressurizing the reservoir. One method to accomplish this is to supply air from the first stage of compression (i.e. from pipe 21) through bleed pipe (33) to chamber (34) behind a movable piston (35) in the oil reservoir. Therefore, if at any time during operation, one of the air compressing pistons bottoms out during the return stroke, and thus ceases to supply fluid to the pump, the pressure in its associated conduit will fall below the reservoir pressure and fluid will be added to the circuit through the low pressure relief valve to restore synchronization so that the cycle will continue to repeat.

While the invention has been described in terms of one preferred embodiment, it is to be expected that various alterations, modifications, or permutations thereof will be apparent to those skilled in the art. Therefore, it is intended that equivalents be embraced within the spirit and scope of the invention as defined by the appended claims.

What is claimed is:

1. A power transfer unit for a gas turbine engine of the type which converts mechanical rotational energy into a flow of pressurized gas, comprising:

swash-plate pump means for producing a sequence of multiple individual pulses of pressurized liquid from the energy of a rotating shaft mechanically connected to said turbine, a plurality of gas compressing piston units which are located remotely from said pump means and which reciprocate in a common plane within a block like housing, said plurality of gas compressing piston units including at least four pistons arranged in at least two pairs of linked pistons, each pair of pistons adapted to move together in response to fluid pressure so that gas is drawn in by one of the pair while gas is forced out by the other of the pair and the linked pistons of one pair move oppositely to the pistons of another pair, and conduit means for transferring each individual pulse of liquid in sequence to and from each one of said plurality of remote piston units to effect reciprocation thereof.

2. The apparatus of claim 1 further including pressure relief valves in communication with said conduit means and in communication with a liquid reservoir, said relief valves adapted to maintain said conduit means full of liquid by allowing liquid to flow to and from the reservoir as necessary.

3. A hydraulically powered pneumatic intensifier for supplying compressed air from a gas turbine engine comprising:

a block like housing;

two first stage air chambers contained within said housing and arranged along a first common longitudinal axis, each chamber in communication with a source of air to be compressed and each in communication with a first stage air transfer pipe;

check valves between each of said air chambers and the source of air, adapted to allow air to enter but not leave said chambers;

a pair of first stage air pistons, one in each of said chambers, connected together by a first link and adapted to reciprocate within said chambers along said common longitudinal axis;

a second stage air chamber and a third stage air chamber contained within said housing and located along a second common longitudinal axis; said second axis being parallel to said first axis so that all of the chambers lie in a common plane;

said second stage air chamber in communication with said first stage air transfer pipe and also in communication with a second stage air transfer pipe;

said third stage air chamber in communication with said second stage air transfer pipe and also in communication with a third stage air delivery pipe;

a second stage air piston with said second stage air chamber and adapted to reciprocate therein;

a third stage air piston within said third stage air chamber and adapted to reciprocate therein;

a second link connecting said second and third stage air pistons so that they reciprocate as a pair;

and hydraulic means for moving said pair of first stage air pistons alternately with said pair of second and third stage air pistons so that air is forced through each of said air chambers and is compressed therein to above its initial pressure;

wherein said hydraulic means includes:

a swash plate hydraulic pump having at least four pumping cylinders located remotely from said block like housing and adapted to be driven by the turbine engine to produce a sequence of pulses of pressurized oil, and conduit means for transferring the pulses of pressurized oil from each of said remote pumping cylinders directly to and from a corresponding one of said air pistons within said block like housing to cause said pistons to reciprocate under the influence of hydraulic pressure.

4. The apparatus of claim 1 wherein said pair of first stage air pistons are substantially of the same size and larger than said second stage air piston which itself is larger than said third stage air piston.

5. The apparatus of claim 1 further including:

intercooler means for cooling gas heated by compression; said means located in the flow path of said second stage air transfer pipe.

6. The apparatus of claim 1 further including valve means in communication with said conduit means and a oil reservoir, said valve means adapted to maintain oil pressure in said conduit means to a level between a selected high pressure level and a selected low pressure level by allowing oil to flow to and from the reservoir as necessary.

7. The apparatus of claim 6 wherein said oil reservoir is located within said block like housing and is adapted to be pressurized by a movable piston acting under the influence of gas from the first stage air transfer pipe.

* * * * *